US010036361B2

(12) United States Patent
Ikeda et al.

(10) Patent No.: US 10,036,361 B2
(45) Date of Patent: Jul. 31, 2018

(54) IGNITION DEVICE

(71) Applicant: Imagineering, Inc., Kobe-shi, Hyogo (JP)

(72) Inventors: Yuji Ikeda, Kobe (JP); Hidekazu Ohtsubo, Kobe (JP)

(73) Assignee: IMAGINEERING, INC., Kobe-shi (JP)

( * ) Notice: Subject to any disclaimer, the term of this patent is extended or adjusted under 35 U.S.C. 154(b) by 0 days.

(21) Appl. No.: 15/503,187

(22) PCT Filed: Aug. 10, 2015

(86) PCT No.: PCT/JP2015/072615
§ 371 (c)(1),
(2) Date: Jul. 12, 2017

(87) PCT Pub. No.: WO2016/024563
PCT Pub. Date: Feb. 18, 2016

(65) Prior Publication Data

US 2017/0298893 A1 Oct. 19, 2017

(30) Foreign Application Priority Data

Aug. 12, 2014 (JP) ..... 2014-164601

(51) Int. Cl.
*H05H 1/52* (2006.01)
*F02P 3/01* (2006.01)

(52) U.S. Cl.
CPC ..... *F02P 3/01* (2013.01); *H05H 1/52* (2013.01)

(58) Field of Classification Search
None
See application file for complete search history.

(56) References Cited

U.S. PATENT DOCUMENTS 4,841,259 A * 6/1989 Mayer ..... H01B 11/12 333/17.2
5,531,834 A * 7/1996 Ishizuka ..... C23C 16/509 118/723 E (Continued)

FOREIGN PATENT DOCUMENTS

JP 2006-132518 A 5/2006
JP 2009-38025 A 2/2009

(Continued)

OTHER PUBLICATIONS

International Search Report dated Dec. 1, 2015, issued in counterpart application No. PCT/JP2015/072615. (2 pages).

*Primary Examiner* — Crystal L Hammond
(74) *Attorney, Agent, or Firm* — Westerman, Hattori, Daniels & Adrian, LLP

(57) ABSTRACT

An ignition device is provided, the ignition device comprises a coaxial structural body comprising an inner conductor 2, an outer conductor 3, and an insulator 4 that insulates both the conductors 2 and 3, which are coaxially provided with one another along an axial direction. A connection terminal 5 is arranged at one axial end side of the coaxial structural body and connecting the inner conductor 2 and the outer conductor 3 to the electromagnetic wave oscillator MW. The inner conductor 2 has a linearly extended part protruding at another axial end side of the coaxial structural body extending outwards from the outer conductor 3 in the axial direction and a spirally extended part continuously extending from the linearly extended part in a reversed direction and in a spiral manner that winds around the linearly extended part of the inner conductor 2 in a predetermined number of turns around the linearly extended part such that the inner conductor 2 forms a resonance structure and the spirally extended part 20 with the resonance structure is obtained. A diameter and a length (Continued)

of the inner conductor 2 that is extended outwards from the outer conductor 3, and the number of turns of the spirally extended part of the inner conductor 2 are determined such that a capacitive reactance XC and an inductive reactance XL of the spirally extended part are substantially equal to each other.

4 Claims, 6 Drawing Sheets

(56) References Cited

U.S. PATENT DOCUMENTS 7,080,638 B2 * 7/2006 Mizutani ..... F02P 3/02 123/635
7,777,401 B2 * 8/2010 Jaffrezic ..... H01T 13/44 123/143 B
8,421,274 B2 * 4/2013 Sun ..... H01F 38/14 307/104
8,476,831 B2 * 7/2013 Lapatovich ..... H01J 65/048 315/39
8,887,683 B2 * 11/2014 Smith ..... F02P 9/007 123/143 B
9,318,922 B2 * 4/2016 Hall ..... B60L 1/00
9,551,315 B2 * 1/2017 Smith ..... F02P 9/007
9,698,575 B2 * 7/2017 Stifel ..... H01T 19/02
9,728,322 B2 * 8/2017 Sano ..... H01F 27/29
9,873,315 B2 * 1/2018 Spencer ..... B60K 5/00
2002/0101315 A1 * 8/2002 Hamer ..... H01F 27/327 336/90
2006/0048732 A1 * 3/2006 Schmidt ..... F02P 23/045 123/143 B
2009/0120394 A1 5/2009 Heise
2010/0034349 A1 * 2/2010 Kraus ..... G01N 21/67 378/41
2010/0074808 A1 * 3/2010 Lee ..... H05B 6/802 422/186.04
2010/0186670 A1 7/2010 Ikeda
2010/0259172 A1 * 10/2010 Nakano ..... F02P 9/007 315/71
2010/0313841 A1 12/2010 Agneray et al.
2011/0101788 A1 * 5/2011 Sun ..... H01F 38/14 307/104
2013/0294558 A1 * 11/2013 Schulte ..... G21B 1/05 376/147
2017/0152829 A1 * 6/2017 Ikeda ..... F02P 23/045
2017/0276110 A1 * 9/2017 Ikeda ..... F02P 13/00

FOREIGN PATENT DOCUMENTS

JP 2009-115093 A 5/2009
JP 2009-281188 A 12/2009
JP 2010-520400 A 6/2010

* cited by examiner

IGNITION DEVICE

TECHNICAL FIELD

The present invention relates to an ignition device, more specifically, an ignition device that resonates an electromagnetic wave, and thereby, generates a high voltage, and causes a discharge.

BACKGROUND ART

Conventionally, the ignition devices that use the plasma generator that generates the electromagnetic wave plasma by irradiating the electromagnetic wave into the combustion chamber of the internal combustion engine, has been suggested as the ignition devices for ignition procedure in the internal combustion engines. For example, in Japanese unexamined patent application publication No. 2009-38025, and Japanese unexamined patent application publication No. 2006-132518, the ignition devices of the internal combustion engine that use such kind of plasma generator are disclosed.

In Japanese unexamined patent application publication No. 2009-38025, the plasma generator in that the spark discharge is generated at the discharge gap of the spark plug, the microwave is irradiated toward the discharge gap, and the plasma is expanded, is disclosed. In such plasma generator, the plasma generated by the spark discharge receives energy from the microwave in pulse. Thereby, electrons at the plasma region are accelerated in speed, ionization is induced, and plasma volume increases.

In Japanese unexamined patent application publication No. 2006-132518, the ignition device of the internal combustion engine in that the plasma discharge is caused by irradiating the electromagnetic wave into the combustion chamber from the electromagnetic wave irradiator, is disclosed. On the top surface of the piston, the electrode for ignition that is insulated from the piston is provided. The electrode for ignition plays a role, in the vicinity thereof, of increasing locally the electric field strength of the electromagnetic wave inside the combustion chamber. Thereby, in the vicinity of the electrode for ignition, the plasma discharge is caused.

PRIOR ART DOCUMENT

Patent Document(s)

Patent Document 1: Japanese unexamined patent application publication No. 2009-38025

Patent Document 2: Japanese unexamined patent application publication No. 2006-132518

SUMMARY OF INVENTION

Problems to be Solved

However, in the plasma generator disclosed in Japanese unexamined patent application publication No. 2009-38025, at least two power sources, i.e., one, the high voltage source for causing the discharge at the spark plug, and the other one, the high frequency source for irradiating the microwave are necessary. For example, supposing that such plasma generator is used for the combustion chamber of for example, automotive engine, there is an inconvenience that it is difficult to secure arranging space for the plasma generator that requires multiple power sources, since there is a space limitation for arrangement. Moreover, as the transmission system of such plasma generator, both the high voltage transmission system and the electromagnetic wave transmission system with regard to the conventional spark plug are required, and based on that, the system is significantly complicated, and it is difficult to generate plasma required for ignition only by the electromagnetic wave, and therefore, firstly, discharge by the spark plug as fire seed is essential. On the other hand, in the plasma generator described in Japanese unexamined patent application publication No. 2006-132518, the plasma is generated by using only the electromagnetic wave, and therefore, only one power source is sufficient for use. However, a large amount of electric power from the high frequency source is required to be supplied in order to ignite and occur combustion only by the electromagnetic wave. Furthermore, supposing that the injector and the ignition device are aligned and arranged in parallel via bracket as the injector incorporated together with the ignition device without remodeling the injector that is used widely and spreadly, when the ignition plug already in existence is used, there is a problem that it is difficult to mount to the internal combustion engine since there is a diameter length reduction limitation for the ignition plug based on the fuel injection amount of the injector.

The present invention is made from the above points. The objective is to provide an ignition device used for, for example, an internal combustion engine, which is a smaller sized ignition device and can cause a high potential difference only by using an electromagnetic wave, ignite fuel, and cause a discharge, without requiring, for example, a spark plug that discharges by high voltage or complicated system.

Means for Solving Problems

An ignition device comprises a coaxial structural body comprising an inner conductor, an outer conductor, and an insulator that insulates both the conductors, which are coaxially provided with one another along an axial direction, an electromagnetic wave oscillator, and a connection terminal arranged at one axial end side of the coaxial structural body and connecting the inner conductor and the outer conductor to the electromagnetic wave oscillator. The inner conductor has a linearly extended part protruding at another axial end side of the coaxial structural body extending outwards from the outer conductor in the axial direction and a spirally extended part continuously extending from the linearly extended part in a reversed direction and in a spiral manner that winds around the linearly extended part of the inner conductor in a predetermined number of turns around the linearly extended part such that the inner conductor forms a resonance structure and the spirally extended part with the resonance structure is obtained, and a diameter and a length of the inner conductor that is extended outwards from the outer conductor, and the number of turns of the spirally extended part of the inner conductor are determined such that a capacitive reactance and an inductive reactance of the spirally extended part are substantially equal to each other.

According to the ignition device of the present invention, the diameter and the length of the inner conductor that is extended from the outer conductor, and the number of winding turns of the spirally extended part are determined such that the capacitive reactance and the inductive reactance of the spirally extended part are substantially equal to each other. Thereby, the spirally extended part can be constituted having the resonance structure, a potential difference of the supplied electromagnetic wave is caused at fixed point of the spirally extended part, and a discharge can occur.

Moreover, a distal end of the spirally extended part is preferably connected to the outer conductor. By adopting such structure, a distance between a point existed on a circumference of the inner conductor that is wound in the spiral manner after linearly extension in the axial direction and reversed, and a point that exists in an extension linearly in the axial direction at the insulator side location in the spirally extended part and closest to the previously-said point on the circumference, is $\lambda/2$ that is provided with regard to a frequency of a supplied electromagnetic wave $\lambda$, a breakdown is caused in a cavity (space) of both the points, and also a discharge is caused.

The length of the inner conductor extending from the outer conductor at another axial end side can be an integral multiple of $\lambda/4$, provided that a frequency of an electromagnetic wave that is inputted from the connection terminal is $\lambda$.

Moreover, the coaxial structural body can be a semi-rigid cable. By being the semi-rigid cable, a widely-spread-usable product can be used, and a cost reduction can be achieved.

Effect of Invention

An ignition device of the present invention comprises a coaxial structural body comprising an inner conductor, an outer conductor, and an insulator that insulates both the conductors, which are coaxially provided with one another along an axial direction. The inner conductor at another axial end side is linearly extended in an axial direction from the outer conductor, then reversed of continuously linearly extended part, formed in a spiral manner, a spirally extended part is obtained, and a supplied electromagnetic wave can be resonated, and discharge can be caused at a fixed point. Therefore, the ignition device in a structure extremely diminished in size that can cause a discharge (spark) only by an electromagnetic wave, is provided.

BRIEF EXPLANATION OF THE DRAWINGS

FIG. 5 (*b*1) is a plan view of a modification of the second embodiment, and FIG. 5 (*b*2) is the cross sectional view cut in Xb-Xb line of (*b*1).

DESCRIPTION OF THE PREFERRED EMBODIMENTS

In below, embodiments of the present invention are illustrated in details, based on figures. Note that, the following embodiments are essentially desirable examples, and the scope of the present invention, the application product, or the use does not intend to be limited.

(First Embodiment)—Ignition Device

Figure 1:
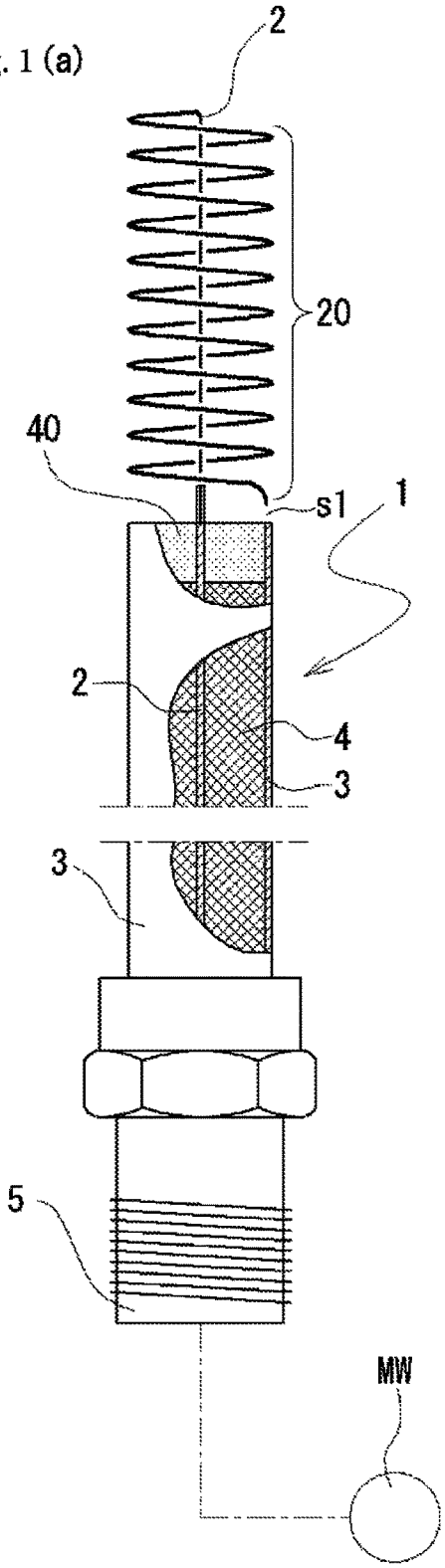
FIG. 1(*a*) and FIG. 1(*b*) illustrate a front view of a cross section that is partially notched, FIG. 1 (*a*) illustrates a state where the distal end of the inner conductor is insulated from the outer conductor, FIG. 1 (*b*) illustrates a state where the distal end of the inner conductor is short-circuited with the outer conductor.
Figure 1:
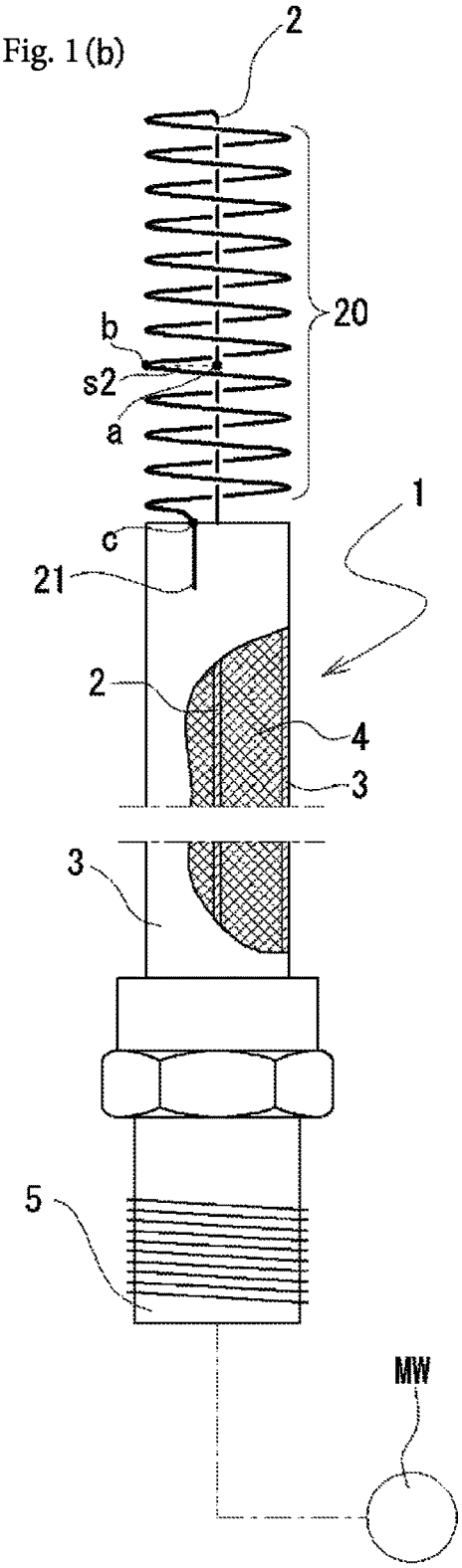

The present first embodiment is an ignition device regarding the present invention. The ignition device 1, as illustrated in FIG. 1, has a coaxial structural body comprising an inner conductor 2, an outer conductor 3, and an insulator 4 that insulates the inner conductor 2 and the outer conductor 3, which are coaxially provided with one another along an axial direction. At one axial end side of the coaxial structural body, a connection terminal 5 that connects the inner conductor 2 and the outer conductor 3 to an electromagnetic wave oscillator MW is arranged. The inner conductor 2 has a linearly extended part protruding at another axial end side of the coaxial structural body extending outwards from the outer conductor 3 in the axial direction and a spirally extended part continuously extending from the linearly extended part in a reversed direction and in a spiral manner that winds around the linearly extended part of the inner conductor 2 in a predetermined number of turns around the linearly extended part (in below, solely referred to "the spirally extended part") such that the inner conductor 2 forms a resonance structure and the spirally extended part 20 with the resonance structure is obtained.

The ignition device 1 makes an electric power of an electromagnetic wave, for example, 2.45 GHz outputted from the electromagnetic wave oscillator MW 500W or the above, and the discharge is caused at the spirally extended part 20.

Figure 3:
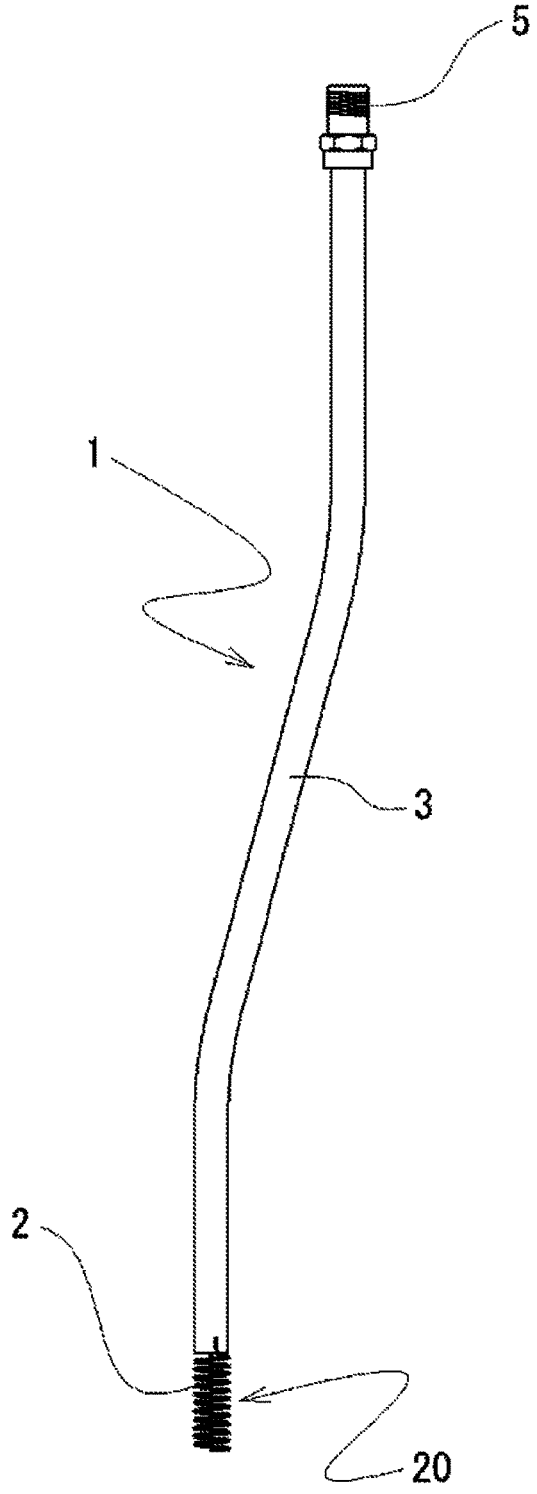
FIG. 3 is a front view that illustrates an example of using a semi-rigid cable as the coaxial structural body.

If the ignition device 1 has the coaxial structural body comprising the inner conductor 2, the outer conductor 3, and the insulator 4 that insulates the inner conductor 2 and the outer conductor 3, which are coaxially provided with one another along the axial direction, it is not specifically limited; however, as illustrated in FIG. 3, so called, a semi-rigid cable can be used. By the semi-rigid cable, a widely-spread-usable product can be utilized, and a cost reduction can be achieved, and the semi-rigid cable can be bent at any arbitral point.

The diameter of the inner conductor 2 is preferably about between 0.25 mm and 1.00 mm, and the diameter of the outer conductor 3 is preferably about between 1.00 mm and 4.00 mm. Moreover, the insulator 4 is preferably composed of, for example, a glass fiber, from a viewpoint of the heat resistance. Furthermore, as illustrated in FIG. 1(*a*), the tip part of the insulator 4 at the spirally extended part 20 side can be composed of, for example, ceramics 40 that is excellent in the heat resistance. In this case, it can also be constituted by filling with such as a ceramic adhesive with heat resistance. Accordingly, the outer diameter of the ignition device 1 becomes almost substantially equal to that of the outer conductor 3, and the ignition device with extremely smaller diameter and diminished in size can be realized. Thereby, a through-hole with smaller diameter only needs to be formed on a cylinder head of an internal combustion engine for mounting the ignition device, and a plurality of ignition devices can be arranged toward one combustion chamber. Or, the gasket part can be remodeled and the ignition device can be arranged thereon. Moreover, the use together with the generally-used spark plug can be performed, and the ignition device 1 is provided in the vicinity of the cylinder wall surface to change the flame propagation orientation from the outside (cylinder wall surface) toward the inside (center of the cylinder). Thereby, a heat loss reduction effect can be achieved.

The ignition device 1 has a structure substantially similar with a normal mode helical antenna structure. In order that the spirally extended part 20 is made to have a resonance structure, a capacitive reactance XC expressed in the following mathematical formula (1) and an inductive reactance XL expressed in the following formula (2) are designed in order to become substantially equal to each other.

$$XC=1/(\omega\cdot C) \quad (1)$$

Here, a capacitance C based on an electric charge is expressed in $$C=\varepsilon\pi N(4,4\alpha H+D)^2/\gamma(1-2\alpha)H)$$

"N" indicates the number of winding turns, "H" indicates the length of the spirally extended part, "D" indicates the diameter of the spirally extended part, "γ" indicates a fixed number, "αH" indicates the height of the electric charge region, and "α" is 0.21.

$$1/(\varepsilon\cdot\omega)=60\lambda$$

"λ" indicates a frequency of the supplied electromagnetic wave.

$$XL=j\omega LA \quad (2)$$

Here, an inductance "LA" is expressed in $$LA=(19.7N^2D^2\cdot 10^{-6})/j(90+20H)$$

The number of winding turns, the length of the spirally extended part, the diameter of the spirally extended part, the frequency λ (for example, 2.45 GHz) of the supplied electromagnetic wave (microwave), which become variable parameters, are substituted into the above formulas (1) and (2), and thereby, values that the capacitive reactance XC and the inductive reactance XL are substantially equal to each other are adopted. Then, based on set number of winding turns, length, and diameter, the spirally extended part 20 is constituted. Thereby, when the distal end of the spirally extended part 20 is not connected to the outer conductor 3, i.e., the distal end of the spirally extended part 20 is insulated from the outer conductor 3, a breakdown occurs in a space s1 between the distal end of the spirally extended part 20 and the outer conductor 3 and the discharge is caused therebetween. On the other hand, when the distal end of the spirally extended part 20 is connected to the outer conductor 3 as a connector 21, i.e., the distal end of the spirally extended part 20 is short-circuited with the outer conductor 3, the breakdown occurs in a space s2 between a point b and a point a and the discharge is caused therebetween. The point b exists on a circumference of the inner conductor 2 that is wound in the spiral manner after linearly extension in the axial direction, i.e. the point b exists on a diameter of the spirally extended part 20. The point a of the inner conductor 2 exists in an extension linearly in the axial direction at the insulator 4 side location in the spirally extended part 20 and is positioned closest to the point b.

Figure 2:
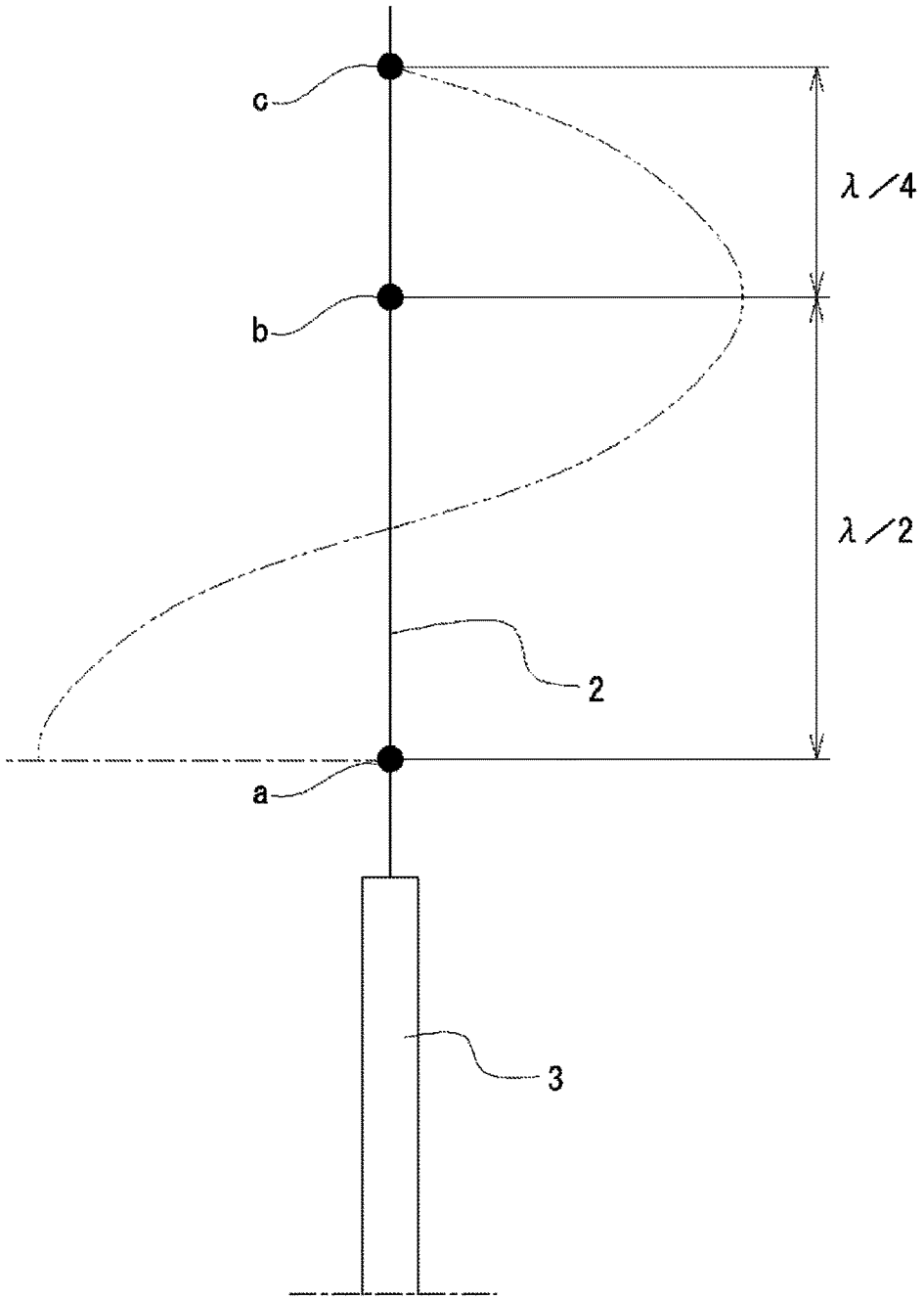
FIG. 2 is a front view partially enlarged that illustrates a state before the inner conductor of the ignition device is reversed and wound in the spiral manner.

The occurrence of discharge when the distal end of the spirally extended part 20 is connected to the outer conductor 3 as the connector 21 is because the setting of the point b is performed such that it is λ/4 distant away from a point c, the λ/4 distant away from the point c is provided with regard to a frequency of a supplied electromagnetic wave λ, the point c becoming potentially equal to the outer conductor 3, i.e., zero potential, and further the setting of the point b is performed such that it is λ/2 distant away from the point a, referring to FIG. 2, and another further, the point c being zero potential corresponds to a node of the wavelength, both the point a and the point b correspond to anti-nodes of the wavelength, and the potential difference between the point b and the point a is largest and the points a and b are set so as to become closest, as illustrated in FIG. 1(*b*). In order that the point a becomes the closest point to the point b, i.e., having a distance substantially equal to the winding radius, a winding turn pitch of the spirally extended part 20 is properly adjusted.

When the source for the electromagnetic wave (not illustrated) receives an electromagnetic wave oscillation signal, for example, ITL signal, from a controller (not illustrated), current in pulse (microwave pulse) is outputted to the electromagnetic wave oscillator MW in a predetermined set pattern of duty ratio, pulse time period and etc. By using a semiconductor oscillator, output, frequency, phase, duty ratio, and pulse time period of the irradiated electromagnetic wave can easily be controlled and changed.

—Behavior of the Ignition Device—

The ignition behavior of the ignition device 1, i.e., plasma generation is explained. In the plasma generation, the plasma is generated in the vicinity of the space s1 and the space s2 by the discharge (spark) in the space s1 and the space s2.

The detailed plasma generation is explained, and firstly the controller outputs an electromagnetic wave oscillation signal with a predetermined frequency λ. When the source for the electromagnetic wave receives such electromagnetic wave oscillation signal from the controller, it outputs the current in pulse with a predetermined duty ratio over a predetermined set time period. The electromagnetic wave oscillator MW outputs the electromagnetic wave pulse with frequency for example 2.45 GHz with the predetermined duty ratio over the set time period. The electromagnetic wave pulse that is outputted from the electromagnetic wave oscillator MW, is fixed based on the above-mentioned formulas (1) and (2), and the inner conductor 2 is extended and reversed in the spiral manner in the state of having the number of winding turns, the diameter and the length such that the capacitive reactance XC and the inductive reactance XL become substantially equal to each other, and thereby the resonance structure is formed and the spirally extended part 20 with having the resonance structure is obtained, and by the spirally extended part 20, the discharge (spark) is generated in the space s1 and the space s2 where the potential difference becomes largest. By the discharge (spark), electrons are released from gaseous molecules in the vicinity of the spirally extended part 20, then the plasma is generated, and eventually the fuel is ignited.

—Effect of the Present First Embodiment—

An ignition device 1 of the present first embodiment has a coaxial structural body comprising an inner conductor 2, an outer conductor 3, and an insulator 4 that insulates both the conductors 2 and 3, which are coaxially provided with one another along an axial direction, and constituted by linearly extending the inner conductor 2 from another axial end side of the outer conductor 3 and reversed at a distal end and formed in a spiral manner, i.e., a spirally extended part 20 is obtained. According to such structure, the supplied electromagnetic wave can be resonated, and the discharge (spark) can be generated at the above-described fixed points. Therefore, the ignition device 1 can be constituted in an extremely smaller size, and the discharge (spark) can be caused only by the electromagnetic wave.

(Second Embodiment)—Injector with the Built-in Ignition Device

In the present second embodiment, the ignition device regarding the present invention is together integrally built with the injector via a bracket, and the injector with the built-in ignition device is used for an internal combustion engine.

Figure 4:
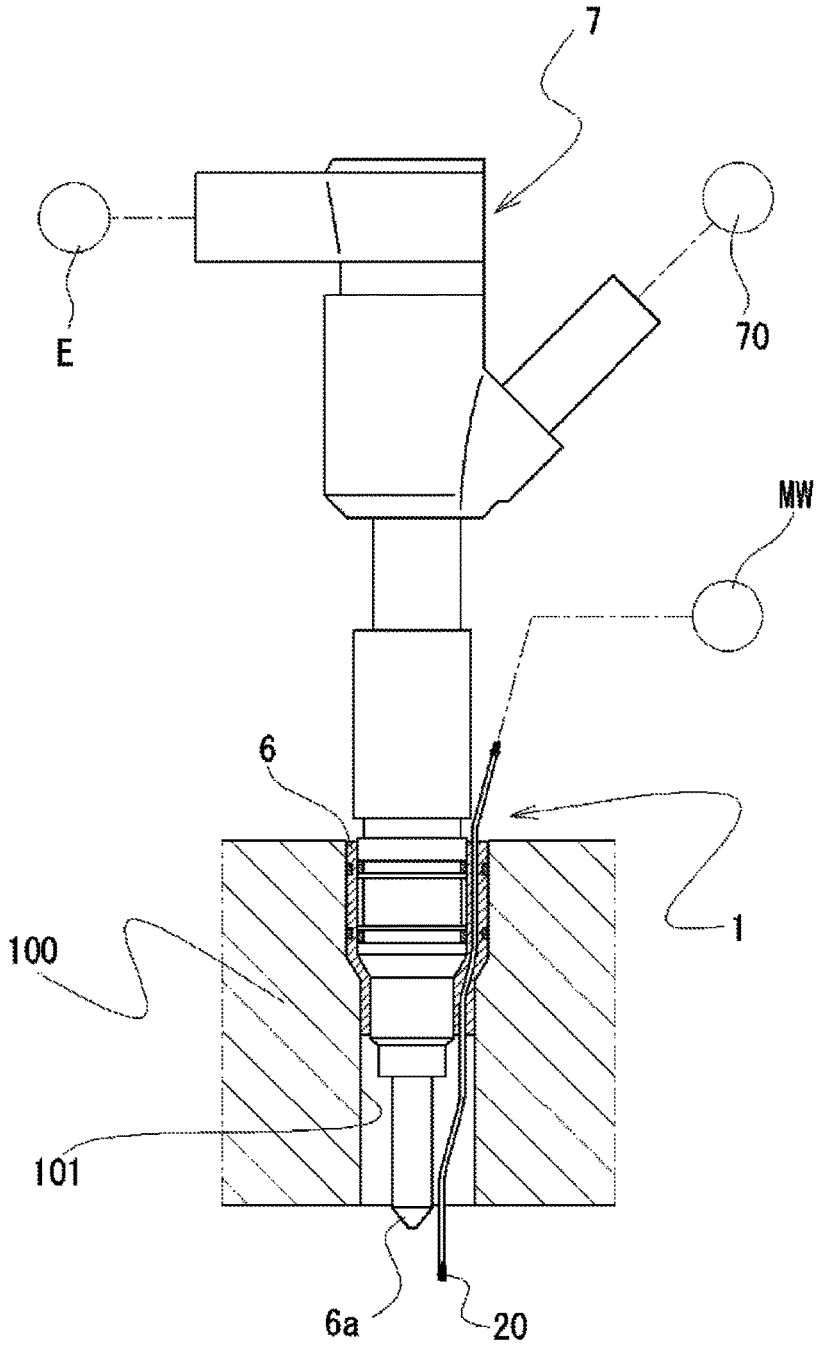
FIG. 4 is a front view of a partially cross section that illustrates an injector with the built-in ignition device of second embodiment.

FIG. 4 illustrates an example that the ignition device 1 is mounted together with the direct injection injector to a cylinder head 100 of the internal combustion engine. The internal combustion engine is, for example, a large diesel truck engine at a secondhand vehicle market which the fuel for use is replaced to gas fuel such as CNG gas or LPG gas from viewpoints of a fuel consumption amount reduction and an environmental engineering. Such technique is called for "retrofit" technique that improves an engine displacement performance by changing or adding a part onto an older assembly, and is recommended by for example, the United States Environmental Protection Agency, "EPA".

As illustrated in figure, the ignition device 1 and the injector 7 are arranged via a bracket 6 to an injector mounting port 101 of the cylinder head 100. The numeral symbol 70 indicates a fuel tank and a pump for supply of fuel, and they operate in synchronized with fuel injection instructions from the controller, for example, ECU, such as fuel-injection-valve-drive-current E energized to an electromagnetic coil actuator that is provided in the injector 7, for example.

Figure 5:
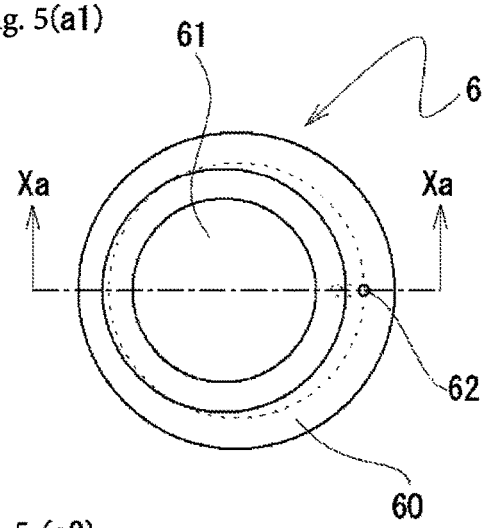
FIG. 5(*a*1), FIG. 5(*a*2), FIG. 5(*b*1) and FIG. 5(*b*2) illustrate a bracket of the injector with the built-in ignition device, (*a*1) is a plan view, (*a*2) is a cross sectional view cut in Xa-Xa line of (*a*1).
Figure 5:
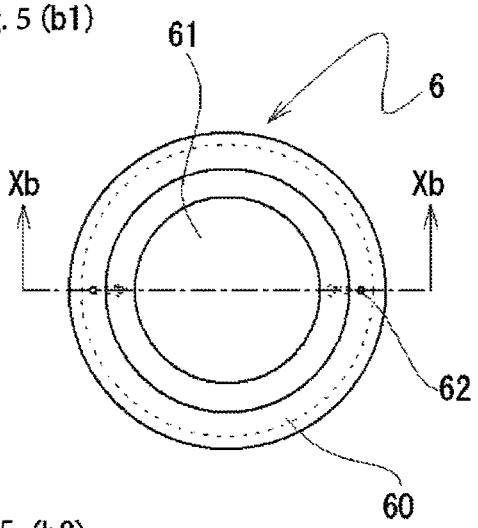
Figure 5:
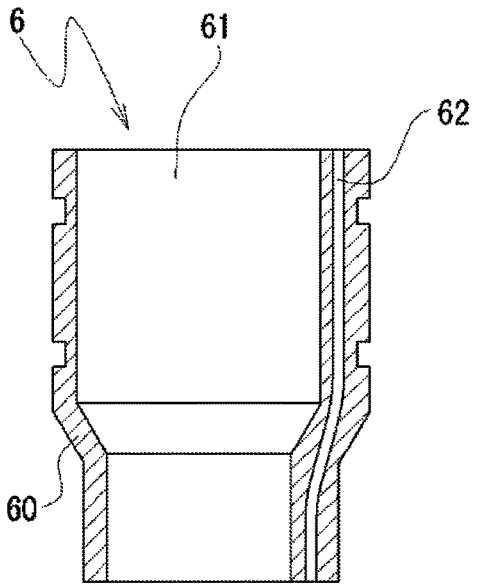
Figure 5:
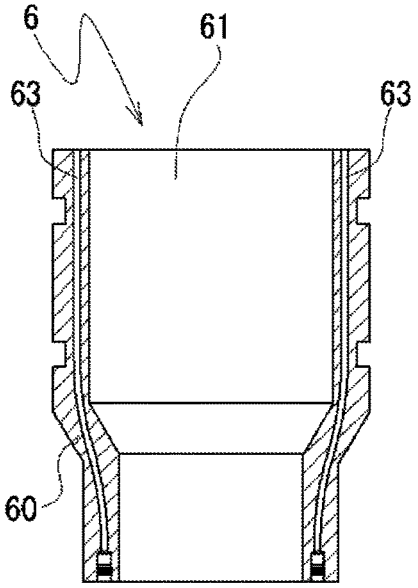

The bracket 6 is, as illustrated in FIG. 5 (*a*1) and (*a*2), a hollow cylindrical member that corresponds to the shape of the injector mounting port 101, and has a groove portion on the outer surface for providing with an O-ring as a sealing member. An injector mounting hole 61 forms a step corresponding to the shape of the injector 7 that is about to be mounted. The injector mounting hole 61 is opened eccentrically to an axial center of the bracket body 60. A hole 62 for mounting the ignition device is opened in a thickness larger part of the injector mounting hole 61. The hole 62 for mounting the ignition device is constituted in a bending manner such that it does not interfere with the step of the bracket 6.

A fixed injector 7 and the ignition device 1 are arranged in the bracket 6 in such structure, and thereby, the injector mounting port 101 of the cylinder head 100 is not required for additional work performance, and as the injector with the built-in ignition device that aligns the injector and the ignition device in parallel, it applies to the "retrofit" technique that fuel of a large diesel truck engine at a secondhand vehicle market is changed to gas fuel. Note that, even in a case where the injector mounting port 101 is performed on the additional work for changing into a larger diameter, the bracket 6 that is suitable for the additionally-work-performed mounting port 101 is manufactured. Thereby, a large capacity of injector 7 is used and utilization together with the ignition device 1 can be achieved.

—Effect of Second Embodiment—

The injector with the built-in ignition device in the present second embodiment, even if it uses as fuel, gas fuel in the diesel engine that the compression-ignition-temperature is higher than the diesel oil and the auto-ignition performance is difficult, can safely ignite the fuel since the ignition device 1 that can discharge only by the electromagnetic wave is built in.

—Modification of the Second Embodiment—

Figure 6:
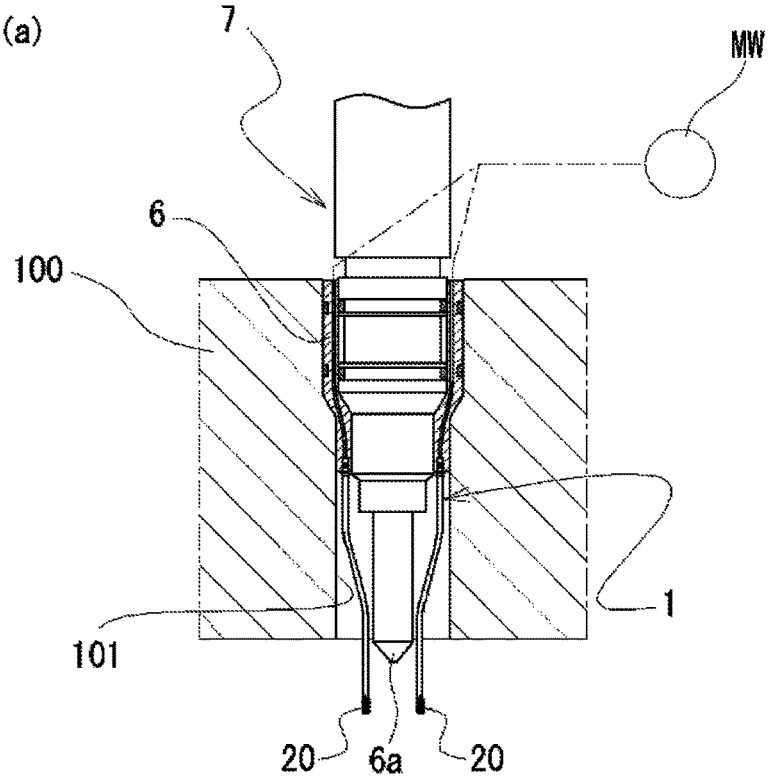
FIG. 6(*a*) and FIG. 6(*b*) illustrate a modification of the injector with the built-in ignition device, FIG. 6 (*a*) is an example that an axial center of the bracket and an axial center of an injector mounting hole are matched with, and FIG. 6 (*b*) is an example that both of the axial centers are eccentric.
Figure 6:
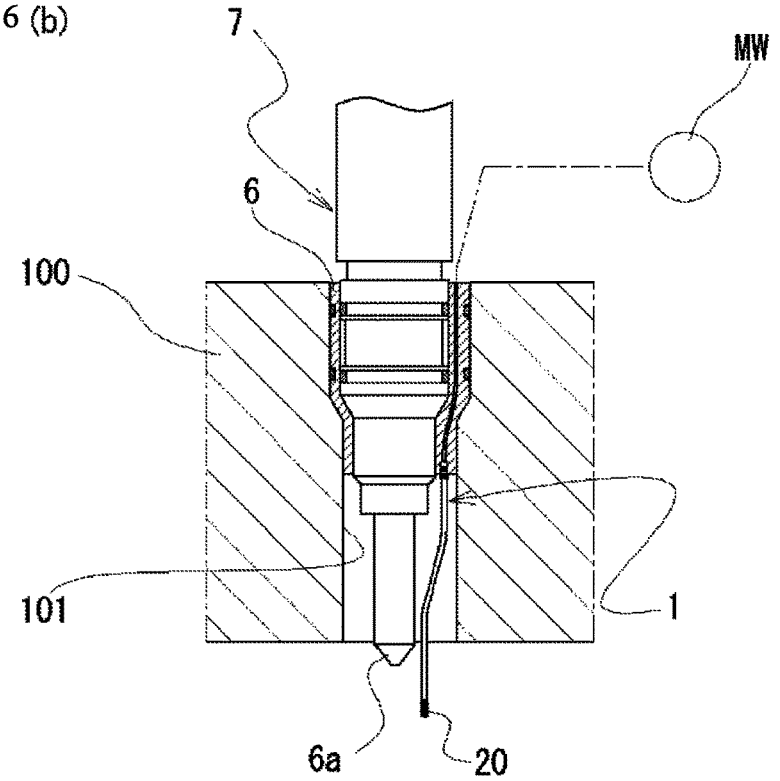

In a modification of the second embodiment, as illustrated in FIG. 5(*b*1), (*b*2), and FIG. 6, female screw parts for attachment into which male screw parts formed on an outer surface of the terminal of the ignition device 1 are engaged, are formed in a hole 63 for mounting the ignition device of the bracket 6 provided at the internal combustion engine side end surface.

By adopting such structure, only you have to do is to insert an electromagnetic wave transmission cable extended from the electromagnetic wave oscillator MW without mounting any ignition device 1 with the coaxial structure into the ignition device mounting hole 63 of the bracket 6. Thereby, the size of the hole 63 diameter can significantly be reduced, the axial center of the bracket 6 and the axial center of the injector mounting hole 61 can be matched with, and a plurality of ignition device mounting holes 63 can be formed on the circumference.

A plurality of ignition device mounting holes 63 are formed on the circumference, and a plurality of ignition devices 1 are arranged, and thereby, ignition of gas fuel can surely be achieved.

Moreover, as illustrated in FIG. 6(*b*), the axial center of the bracket 6 is eccentric to the axial center of the injector mounting hole 61. As well as the second embodiment, the ignition device 1 may be arranged at only one position.

INDUSTRIAL APPLICABILITY

As explained as above, an ignition device of the present invention can cause the discharge only by the electromagnetic wave to generate a plasma. Moreover, the ignition device has a smaller diameter, and therefore, multiple ignition devices can be arranged in an internal combustion engine. Moreover, the ignition device can be constituted integrally together with the injector, and suitably used in not only the generally-used internal combustion engine, but also, for example, in a large diesel truck engine at a secondhand vehicle market which the fuel is replaced to gas fuel such as CNG gas or LPG gas from the viewpoints of fuel consumption amount reduction and the environmental engineering.

EXPLANATION OF REFERENCES

1 Ignition Device
2 Inner Conductor
20 Spirally Extended Part
21 Connector
3 Outer Conductor
4 Insulator
5 Connection Terminal
6 Bracket
60 Bracket Main Body
61 Injector Mounting Hole
62 Ignition Device Mounting Hole
7 Injector
XC Capacitive Reactance
XL Inductive Reactance
MW Electromagnetic Wave Oscillator

The invention claimed is:

1. An ignition device comprising:

a coaxial structural body comprising an inner conductor, an outer conductor, and an insulator that insulates both the conductors, which are coaxially provided with one another along an axial direction;

an electromagnetic wave oscillator; and a connection terminal arranged at one axial end side of the coaxial structural body and connecting the inner conductor and the outer conductor to the electromagnetic wave oscillator, wherein the inner conductor has a linearly extended part protruding at another axial end side of the coaxial structural body extending outwards from the outer conductor in the axial direction and a spirally extended part continuously extending from the linearly extended part in a reversed direction and in a spiral manner that winds around the linearly extended part of the inner conductor in a predetermined number of turns around the linearly extended part such that the inner conductor forms a resonance structure and the spirally extended part with the resonance structure is obtained, and a diameter and a length of the inner conductor that is extended outwards from the outer conductor, and the number of turns of the spirally extended part of the inner conductor are determined such that a capacitive reactance and an inductive reactance of the spirally extended part are substantially equal to each other.

2. The ignition device according to claim 1, wherein a distal end of the spirally extended part is connected to the outer conductor.

3. The ignition device according to claim 1, wherein the length of the inner conductor extending from the outer conductor is an integral multiple of $\lambda/4$, provided that a frequency of an electromagnetic wave that is inputted from the connection terminal is $\lambda$.

4. The ignition device according to claim 1, wherein the coaxial structural body is a semi-rigid cable.

* * * * *